US010792552B2

(12) United States Patent
Shigeta

(10) Patent No.: US 10,792,552 B2
(45) Date of Patent: Oct. 6, 2020

(54) DISPOSAL BOX FOR USED PLAYING CARDS

(71) Applicant: ANGEL PLAYING CARDS CO., LTD., Higashiomi, Shiga (JP)

(72) Inventor: Yasushi Shigeta, Shiga (JP)

(73) Assignee: ANGEL PLAYING CARDS CO., LTD., Shiga (JP)

( * ) Notice: Subject to any disclaimer, the term of this patent is extended or adjusted under 35 U.S.C. 154(b) by 0 days.

(21) Appl. No.: 16/099,923

(22) PCT Filed: May 9, 2017

(86) PCT No.: PCT/JP2017/017521

§ 371 (c)(1),
(2) Date: Nov. 8, 2018

(87) PCT Pub. No.: WO2017/195771

PCT Pub. Date: Nov. 16, 2017

(65) Prior Publication Data

US 2019/0275406 A1 Sep. 12, 2019

(30) Foreign Application Priority Data

May 13, 2016 (JP) ..... 2016-109416

(51) Int. Cl.
*A63F 1/06* (2006.01)
*B65D 25/56* (2006.01)
(Continued)

(52) U.S. Cl.
CPC ..... *A63F 1/062* (2013.01); *A63F 1/06* (2013.01); *A63F 1/067* (2013.01); *B65D 25/56* (2013.01);
(Continued)

(58) Field of Classification Search
CPC ..... G07F 17/3293; G07F 17/3241; A63F 3/00157; A63F 2003/00943;
(Continued)

(56) References Cited

U.S. PATENT DOCUMENTS 3,433,185 A * 3/1969 Roberts ..... E05G 1/005 109/55
6,203,012 B1 * 3/2001 Peron ..... A63F 1/10 273/148 A
(Continued)

FOREIGN PATENT DOCUMENTS

JP 1982-003627 U 1/1982
JP 1994-039734 U 5/1994
(Continued)

OTHER PUBLICATIONS

International Search Report dated Aug. 1, 2017 issued in corresponding PCT Application PCT/JP2017/017521.

*Primary Examiner* — Benjamin Layno
(74) *Attorney, Agent, or Firm* — Norton Rose Fulbright US LLP

(57) ABSTRACT

A disposal box for used playing cards has a cuboid shape provided with six surfaces, namely, front and back surfaces, left and right surfaces, and upper and lower surfaces in an assembled state. The disposal box includes a slit that is provided in at least one of the six surfaces and enables the used playing cards to be inserted into the disposal box. The disposal box further includes viewing windows that are provided with a plurality of holes having a size at which the playing card cannot be taken out, and can allow the used playing cards contained in the disposal box to be visually recognized. The disposal box is formed of a paper or plastic material, and can be discarded in a state in which the used playing cards are contained in the disposal box.

26 Claims, 19 Drawing Sheets

(51) Int. Cl.

| | |
|---|---|
| ***B65F 1/02*** | (2006.01) |
| ***B65F 1/00*** | (2006.01) |
| *A63F 3/00* | (2006.01) |
| *A63F 1/10* | (2006.01) |
| *G07F 17/32* | (2006.01) |
| *A63F 9/24* | (2006.01) |

(52) U.S. Cl.
CPC ..... *B65F 1/00* (2013.01); *B65F 1/02* (2013.01); *A63F 1/10* (2013.01); *A63F 3/00157* (2013.01); *A63F 2003/00164* (2013.01); *A63F 2003/00943* (2013.01); *A63F 2009/242* (2013.01); *A63F 2250/58* (2013.01); *B65D 2203/02* (2013.01); *B65F 2210/138* (2013.01); *B65F 2210/144* (2013.01); *B65F 2250/108* (2013.01); *B65F 2250/114* (2013.01); *G07F 17/3241* (2013.01); *G07F 17/3293* (2013.01)

(58) Field of Classification Search
CPC ..... A63F 2250/58; A63F 1/062; A63F 1/10; A63F 2003/00164; A63F 2009/242
USPC ..... 273/148 A, 148 R, 309, 149 R
See application file for complete search history.

(56) References Cited

U.S. PATENT DOCUMENTS

| | | | | |
|---|---|---|---|---|
| 2013/0307215 | A1* | 11/2013 | Shigeta | A63F 1/14 273/149 R |
| 2015/0283453 | A1* | 10/2015 | Miller | A63F 3/062 273/287 |

FOREIGN PATENT DOCUMENTS

| | | | |
|---|---|---|---|
| JP | 10-081376 | A | 3/1998 |
| JP | 3150417 | U | 5/2009 |
| JP | 2015-517826 | A | 6/2015 |
| WO | 2013/172038 | A1 | 11/2013 |

* cited by examiner

DISPOSAL BOX FOR USED PLAYING CARDS

CROSS-REFERENCE TO RELATED APPLICATIONS

This application is a national phase application under 35 U.S.C. § 371 of International Application No. PCT/JP2017/017521 filed 9 May 2017, the entire contents of which is specifically incorporated by reference herein without disclaimer.

TECHNICAL FIELD

The present invention relates to a disposal box for used playing cards for preventing the used playing cards from being illegally taken out in a card game and certainly discarding the used playing cards.

BACKGROUND ART

In various card games such as poker, baccarat, bridge, or blackjack, a dealer sets playing cards of one deck or a plurality of decks on a card shooter or the like, discharges the playing cards of one deck or the plurality of decks one by one from the card shooter or the like, and distributes the playing cards to game participants. In order to prevent the playing cards after being used in the game from being used for illegal purposes, the playing cards after being used in the game should be managed so as not to be lost or stolen by being temporality stored in a plastic case and be then discarded.

For example, International Publication No. 2013/172038 discloses a conventional card disposal system for managing and discarding used playing cards.

SUMMARY OF INVENTION

Technical Problem

Since the conventional card disposal system uses a large-scale card disposal apparatus that confirms on a game table whether or not the number of cards after being used on the game table corresponds to a predetermined number (for example, 52 cards×8 decks=416 cards when 8 decks are used), maintenance of the apparatus is laborious. In addition, cards remaining without being used in the game among the 416 cards also need to pass one by one through the apparatus in order to manage the number of cards, which takes time and effort and hinders an efficient operation of the game. Therefore, it is not appropriate to use the conventional card disposal system in a casino using a large amount of cards.

The present invention has been made in consideration of the above problems, and an object of the present invention is to provide a disposal box for used playing cards capable of easily and certainly discarding the used playing cards in a package unit without the used playing cards being illegally taken out by managing the used playing cards in a package unit including a predetermined number of playing cards (for example, 52 cards×8 decks=416 cards when 8 decks are used) used in a game.

Solution to Problem

In order to achieve the above object, a disposal box for used playing cards according to the present invention is a disposal box for used playing cards having a cuboid shape provided with six surfaces, namely, front and back surfaces, left and right surfaces, and upper and lower surfaces in an assembled state, and includes a slit that is provided in at least one of the six surfaces of the disposal box and enables the used playing cards to be inserted into the disposal box, viewing windows that are provided in at least one of the front surface, the back surface, the left surface and the right surface of the disposal box in order to confirm an amount or a content of used playing cards contained in the disposal box, and a viewing hole that is provided in the upper surface of the disposal box in order to confirm existence of the used playing cards contained in the disposal box, wherein the viewing windows are provided as a plurality of holes having a size at which the playing card cannot be taken out, and can allow the used playing cards contained in the disposal box to be visually recognized. The disposal box is formed of a paper or plastic material, and can be discarded in a state in which the used playing cards are contained in the disposal box.

Advantageous Effects of Invention

According to the present invention, it is possible to easily and certainly discard used playing cards in a package unit without the used playing cards being illegally taken out, which leads to reduction in operation cost, and improvement of safety as well as improvement of workability of a game in a casino.

DESCRIPTION OF EMBODIMENTS

Figure 1:
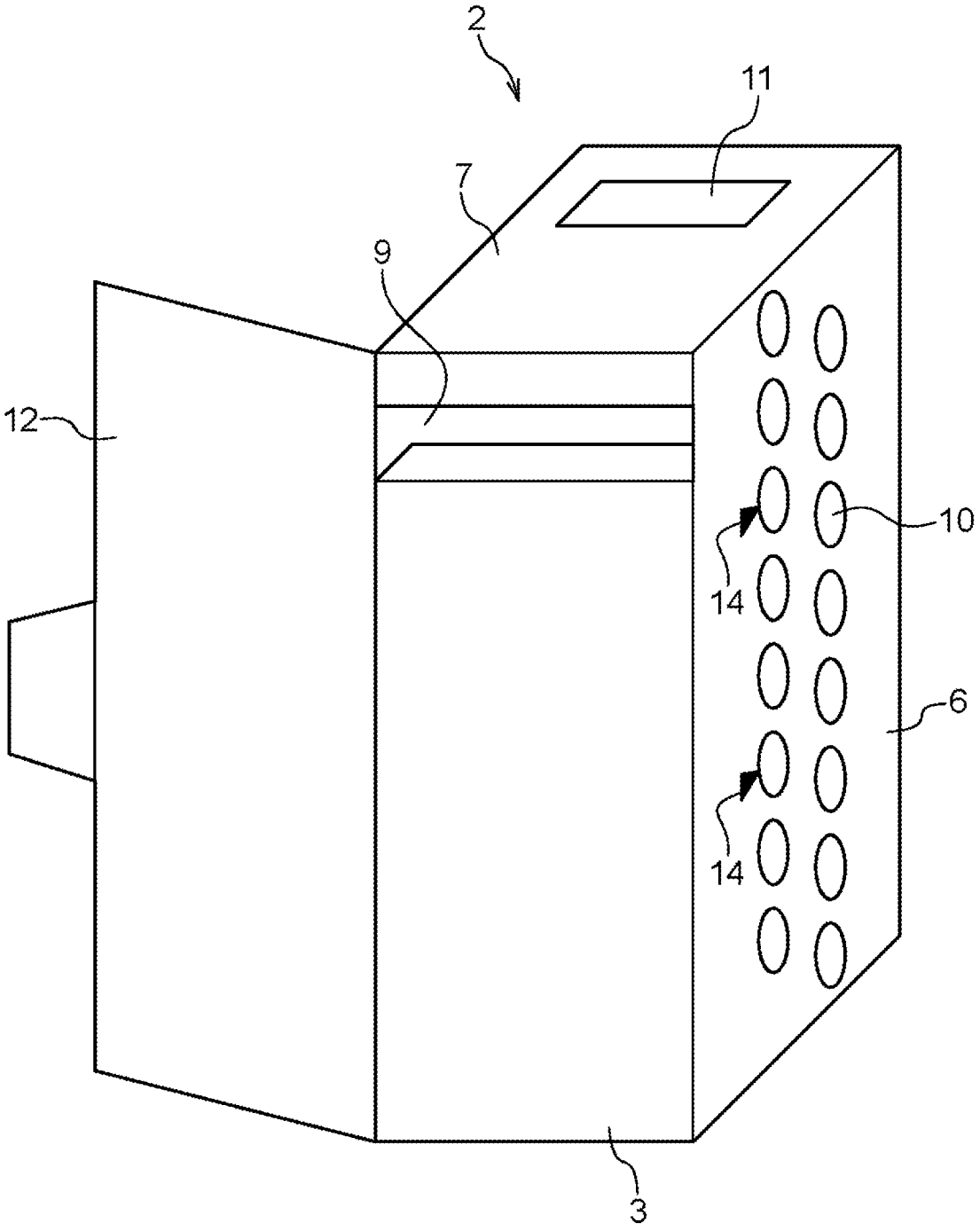
FIG. 1 is a perspective view of a disposal box according to a first embodiment of the present invention.
Figure 2:
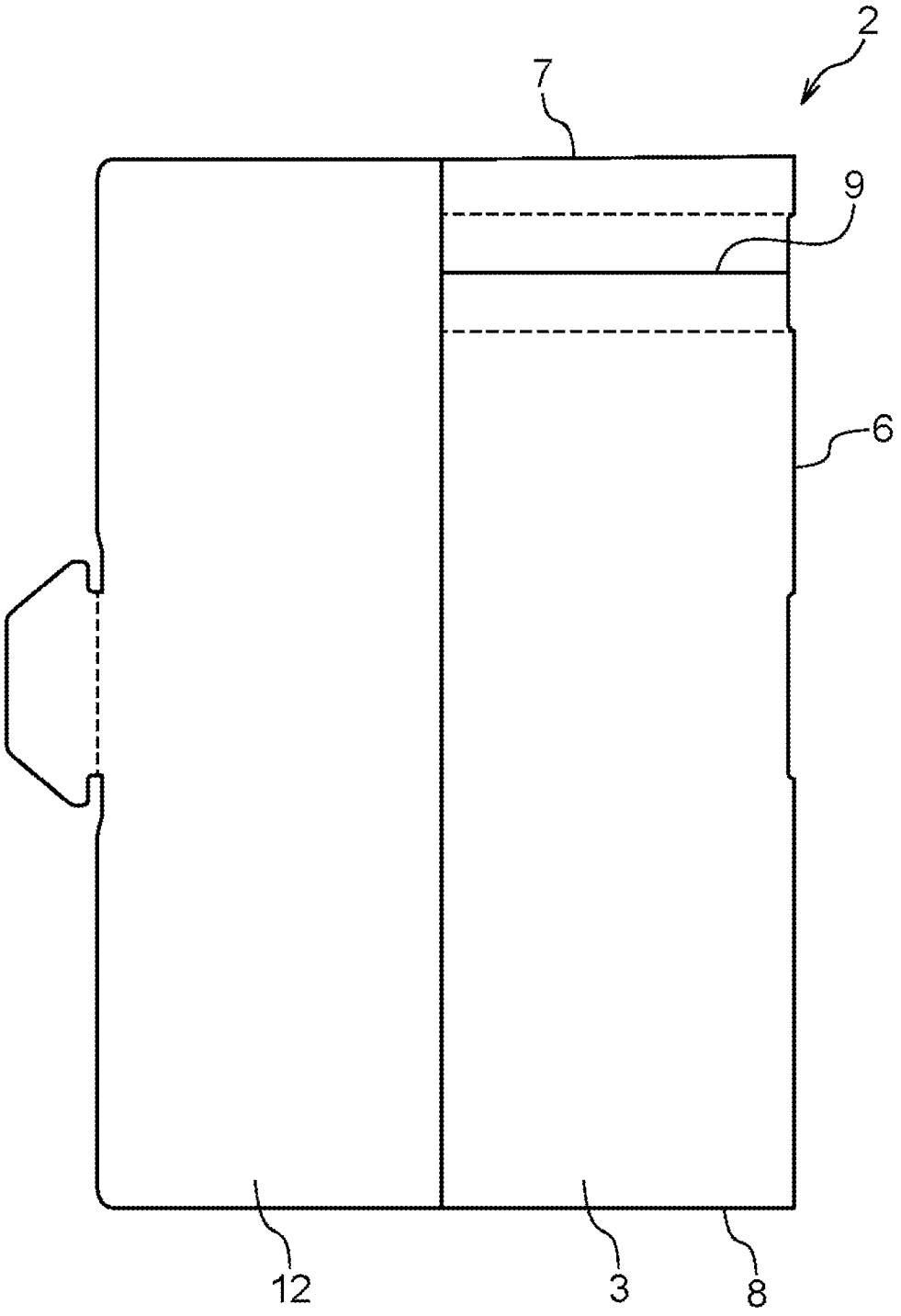
FIG. 2 is a front view of the disposal box according to the first embodiment of the present invention in a state in which a slit cover of the disposal box is opened.
Figure 3:
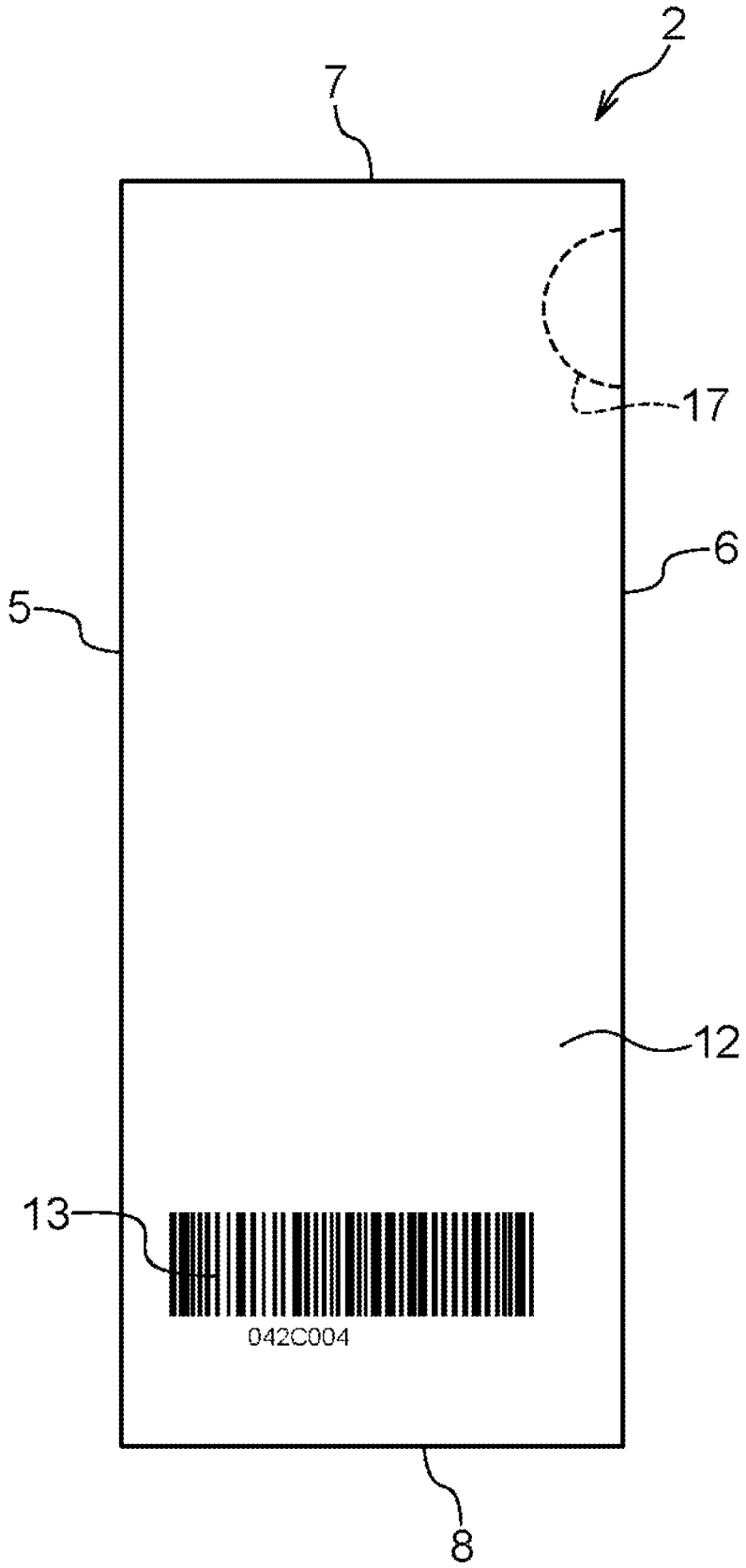
FIG. 3 is a front view of the disposal box according to the first embodiment of the present invention in a state in which the slit cover of the disposal box is closed.
Figure 9:
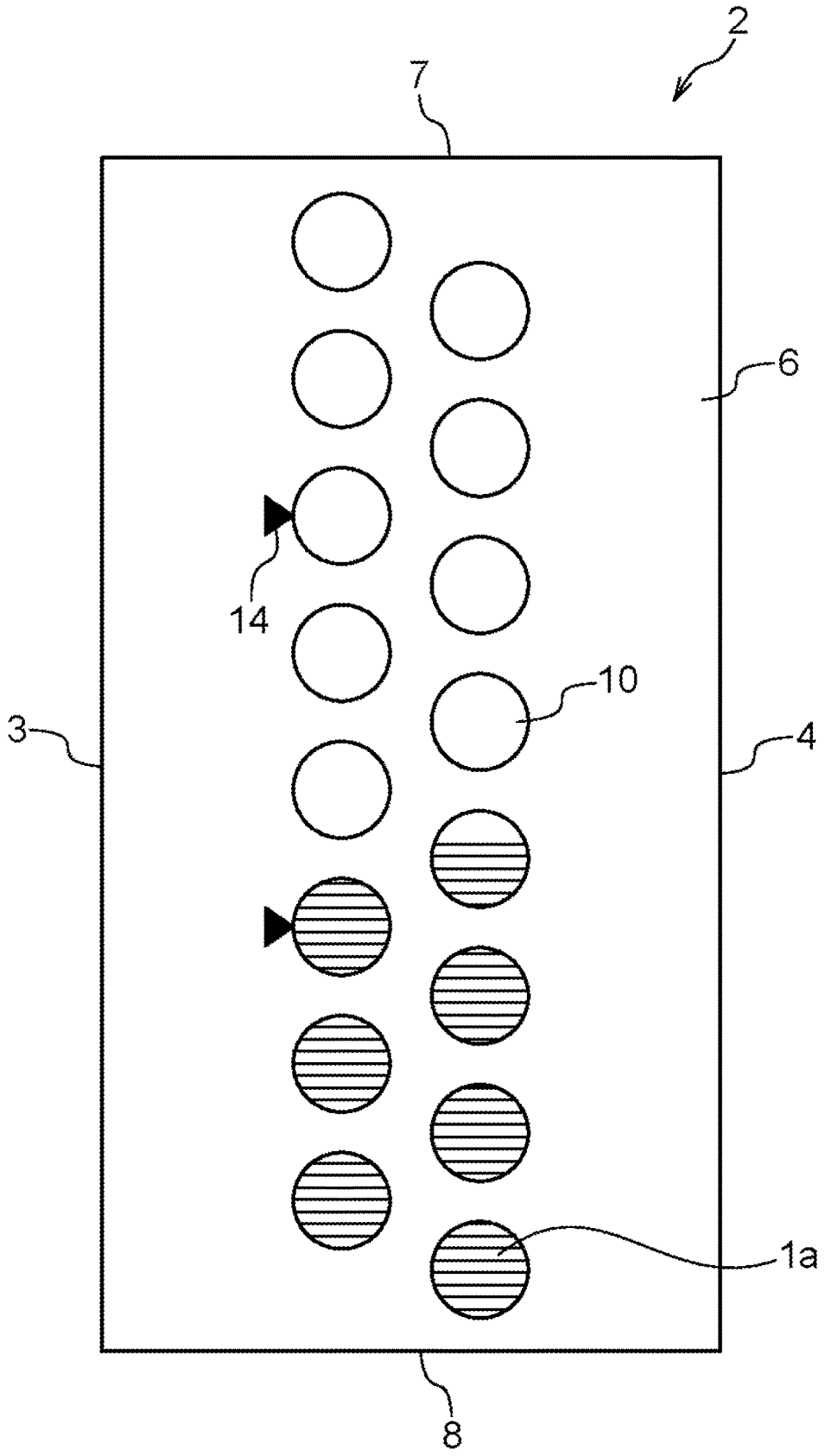
FIG. 9 is a right side view illustrating a state in which used playing cards of the disposal box according to the first embodiment of the present utility model are accommodated.

A first embodiment of the present invention will be described with reference to the drawings. FIG. 1 is a perspective view of a disposal box for used playing cards according to a first embodiment of the present invention. FIG. 2 is a front view of the disposal box according to the first embodiment of the present invention in a state in which a slit cover of the disposal box is opened, and FIG. 3 is a front view of the disposal box according to the first embodiment of the present invention in a state in which the slit cover of the disposal box is closed. In addition, FIGS. 4 to 8 are, respectively, a right side view, a plan view, a bottom view, a left side view, and a development view of the disposal box according to the first embodiment of the present invention, and FIG. 9 is a right side view of the disposal box in a state in which used playing cards are accommodated.

A disposal box 2 for used playing cards has a cuboid shape provided with six surfaces, namely, a front surface 3, a back surface (rear surface) 4, a left surface 5, a right surface 6, an upper surface 7, and a lower surface (bottom surface) 8 in an assembled state. As illustrated in the development view of FIG. 8, the disposal box 2 is composed of a single sheet of material as a whole, and is three-dimensionally assembled as illustrated in FIG. 1 by adhering margin portions to each other. The disposal box 2 is formed of a paper or plastic material. The upper surface 7 and the bottom surface 8 of the disposal box 2 are designed to be slightly larger than the playing cards to be accommodated in the disposal box, and the used playing cards are stacked in a vertical direction to be horizontal to the upper surface 7 and the bottom surface 8 and are accommodated in the disposal box 2.

A slit 9 that enables the used playing cards to be inserted into the disposal box 2 is provided in at least one of the six surfaces of the disposal box 2. In the present embodiment, the slit 9 is provided in an upper part of the front surface 3. The disposal box 2 is further provided with a slit cover 12 covering the slit 9. In addition, a plurality of viewing windows 10 for confirming an amount or a content of used playing cards 1*a* contained in the disposal box are formed in at least one of the front surface 3, the back surface 4, the left surface 5, and the right surface 6 of the disposal box 2. In the present embodiment, the plurality of viewing windows 10 are formed in the right surface 6. In addition, a viewing hole 11 for confirming existence of the used playing cards 1*a* contained in the disposal box is formed in the upper surface 7 of the disposal box 2.

Figure 4:
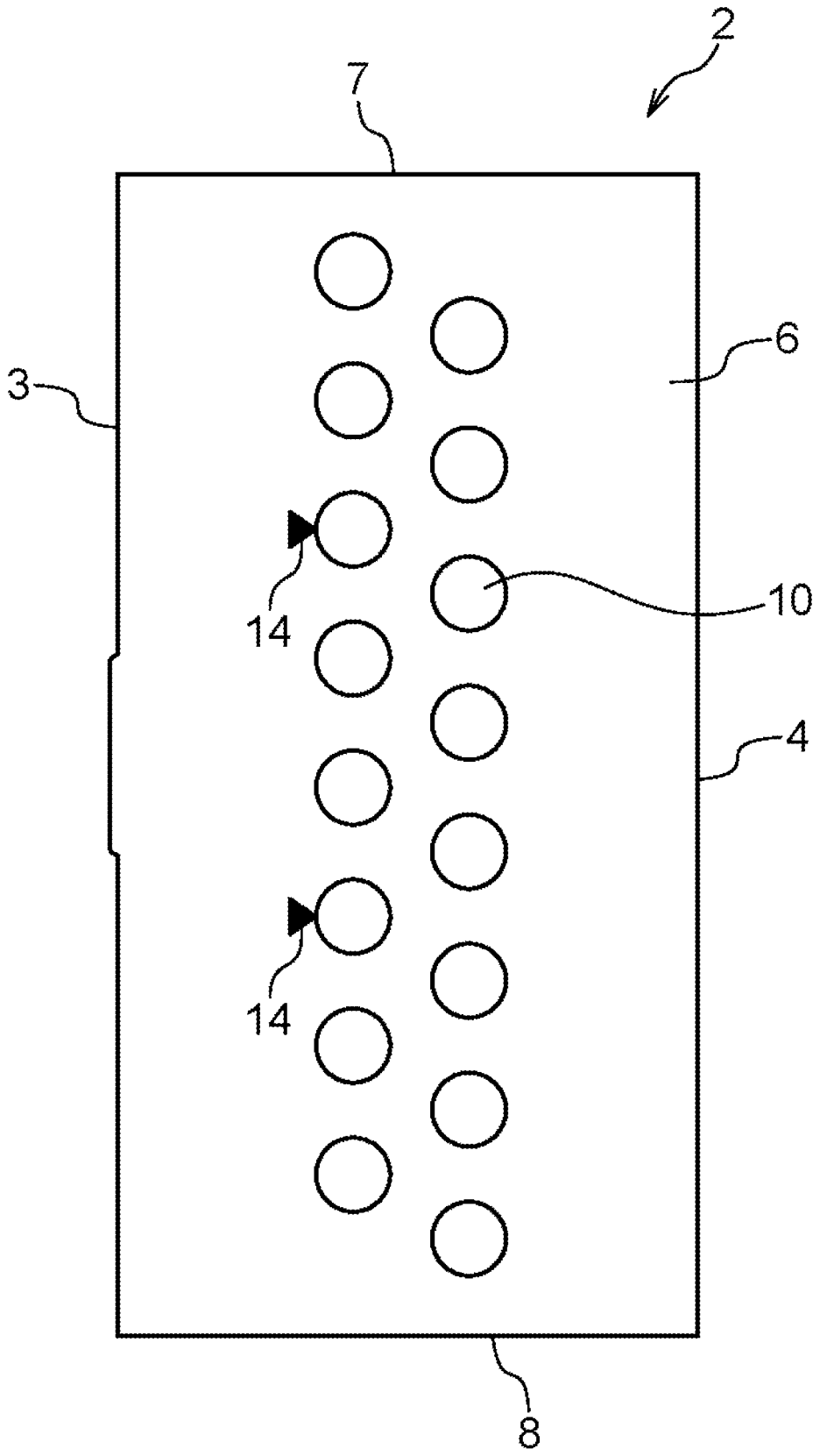
FIG. 4 is a right side view of the disposal box according to the first embodiment of the present invention.
Figure 5:
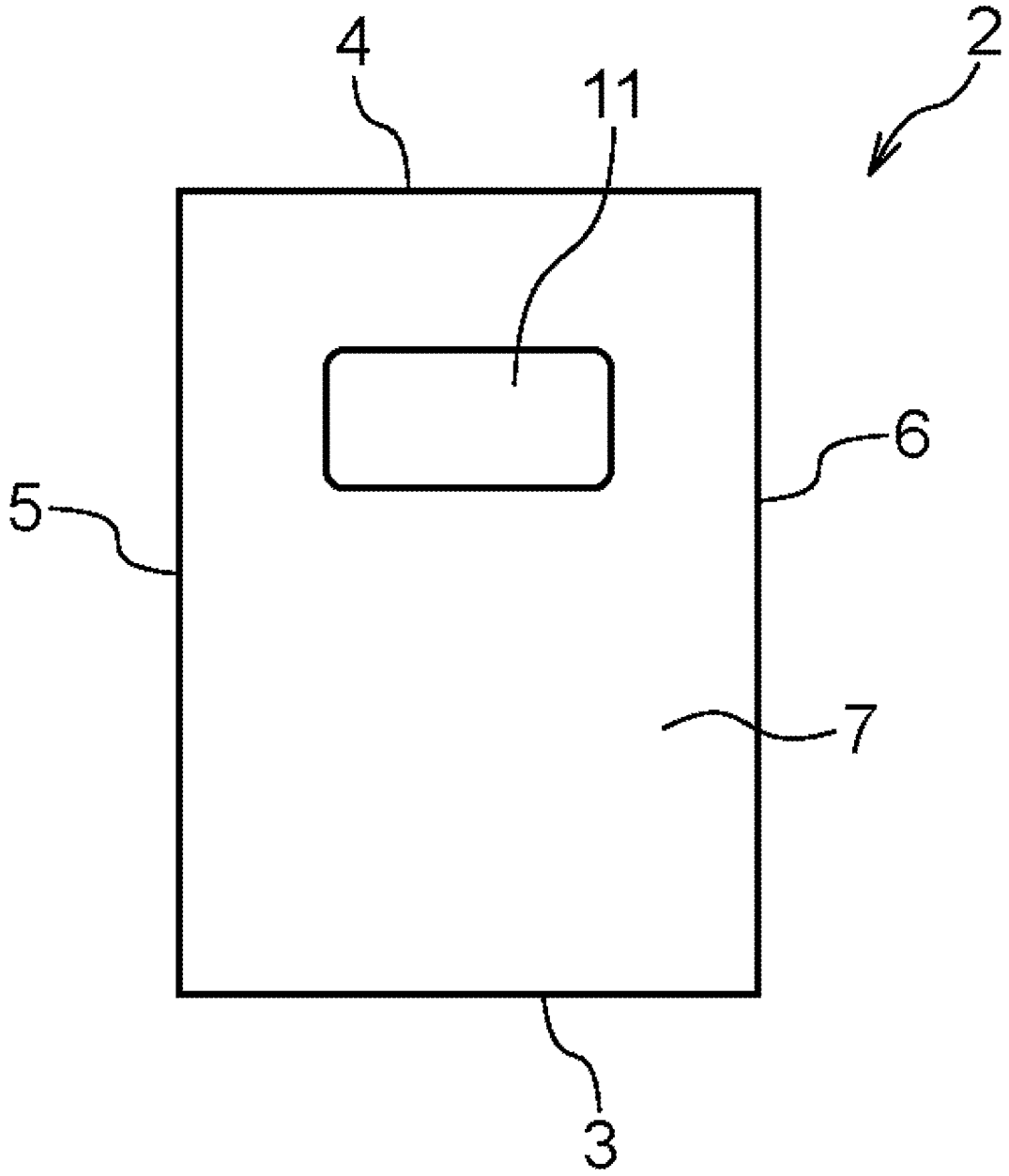
FIG. 5 is a plan view of the disposal box according to the first embodiment of the present invention.
Figure 6:
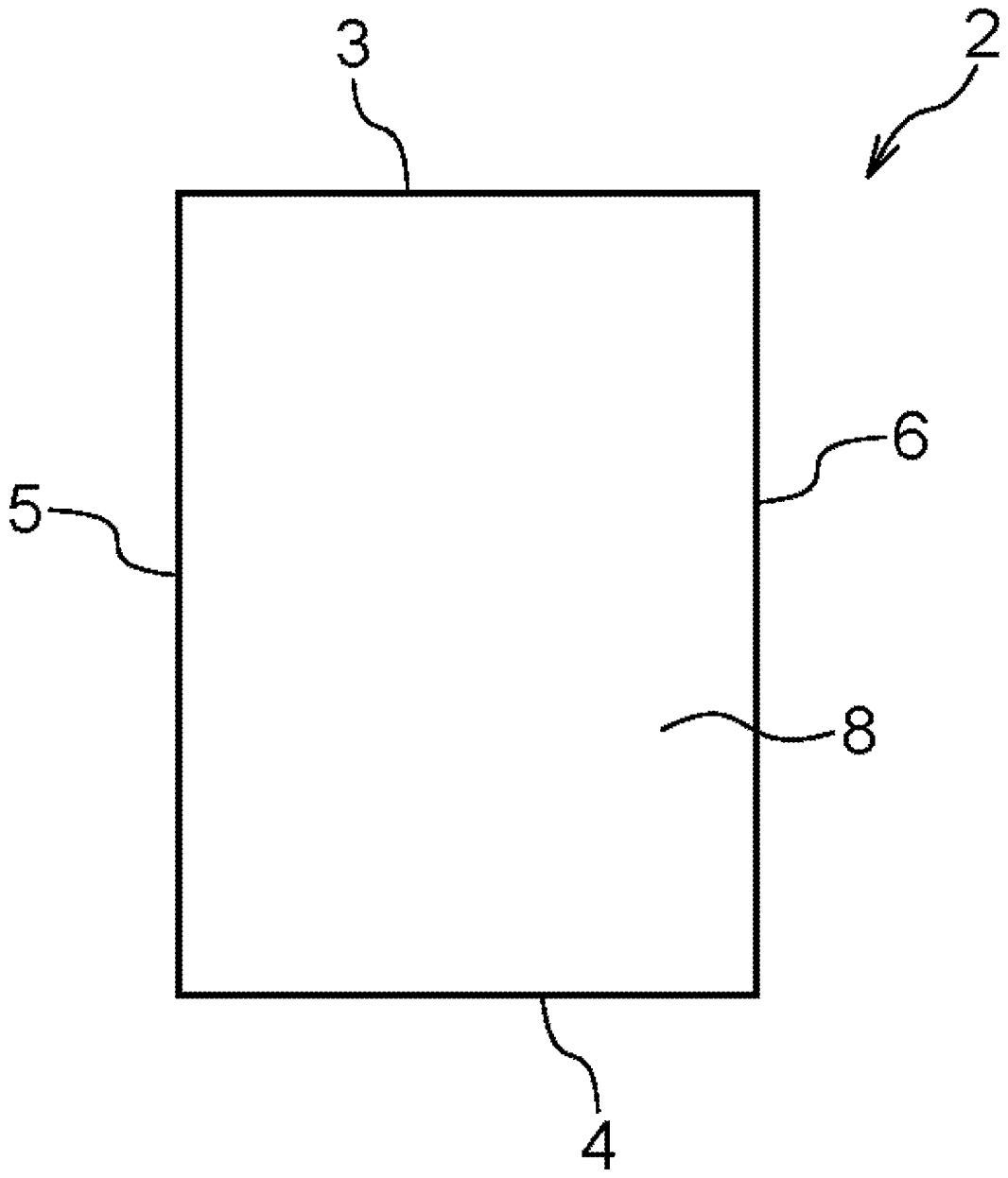
FIG. 6 is a bottom view of the disposal box according to the first embodiment of the present invention.
Figure 7:
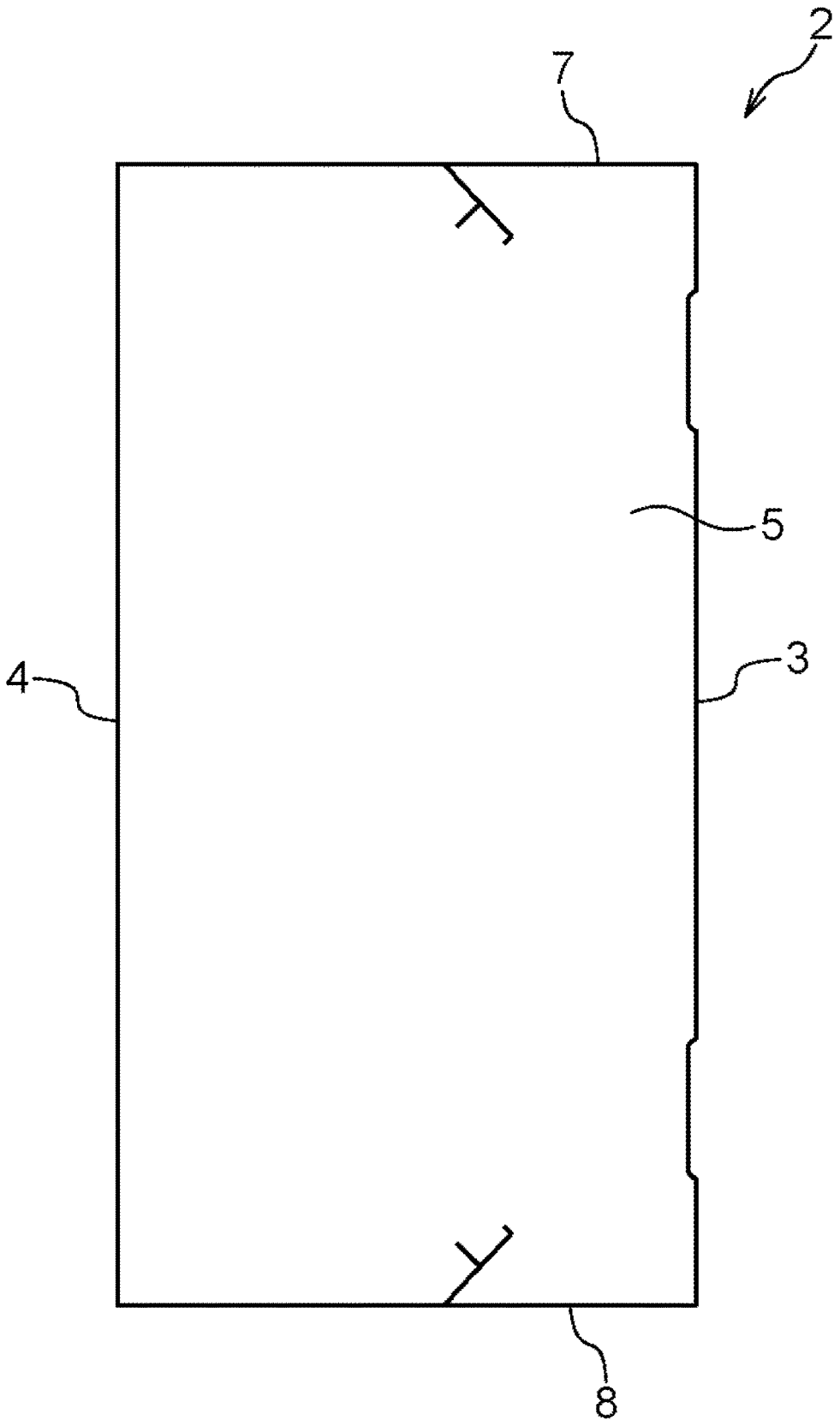
FIG. 7 is a left side view of the disposal box according to the first embodiment of the present invention.
Figure 8:
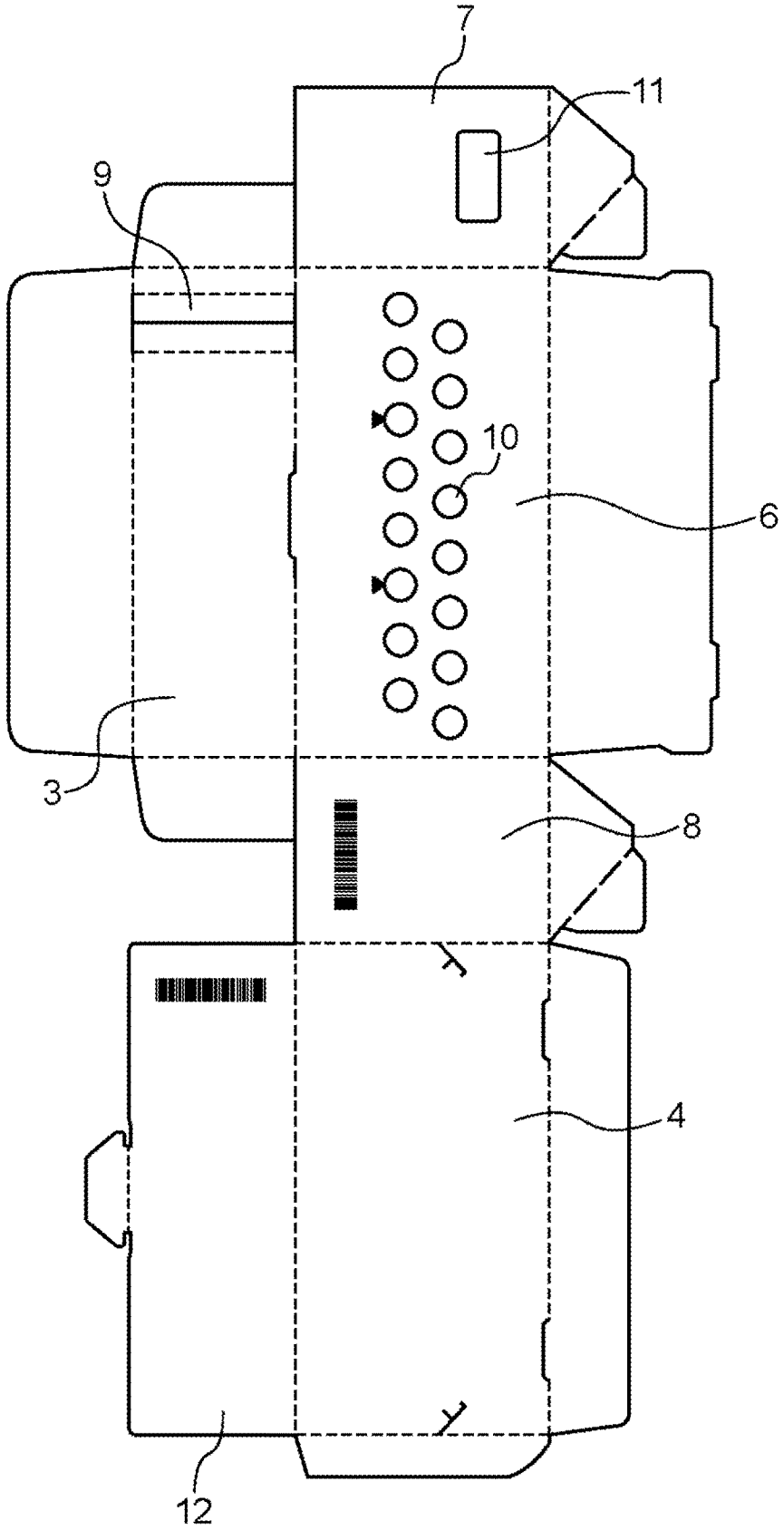
FIG. 8 is a development view of the disposal box according to the first embodiment of the present invention.

As illustrated in FIG. 4, each viewing window 10 is formed as a circular hole. Each viewing window 10 is designed to have a size at which the playing cards accommodated in the disposal box 2 cannot be taken out from the disposal box 2. The plurality of viewing windows 10 form lines side by side in a longitudinal direction, that is, a direction in which the used playing cards are stacked in the disposal box 2. A plurality of (two in the present embodiment) these lines are arranged in a transverse direction, that is, a plane direction of each used playing card accommodated in the disposal box, and the viewing windows 10 are alternately provided between adjacent lines, such that each used playing card 1*a* contained in the disposal box can always be visually recognized from any one of the holes. In addition, the viewing hole 11 is formed at a size at which the playing cards cannot be taken out. Guide indications 14 that indicate the number of used playing cards contained in the disposal box are attached to the right surface 6 in which the viewing windows 10 are provided.

The disposal box 2 includes the slit cover 12 for sealing the slit 9 after a predetermined number of used playing cards 1*a* are inserted into the disposal box. The slit cover 12 is provided with a barcode 13 representing an identification code (ID code) different for each disposal box 2. A predetermined number of playing cards 1 are packaged. The playing cards 1 of each package are shuffled, and a card arrangement of the playing cards 1 in each package is unique for each package.

The ID code is given in a format of a barcode to each package in order to specify the corresponding package. The used playing cards 1*a* used in a game are inserted into the same disposal box 2 in a package unit. A unique ID code associated with the ID code attached to the package is given in the format of the barcode 13 to the disposal box 2. It should be noted that the ID code may be given to the package or the disposal box 2 by printing a content thereof as it is (rather than the format of the barcode).

Figure 10:
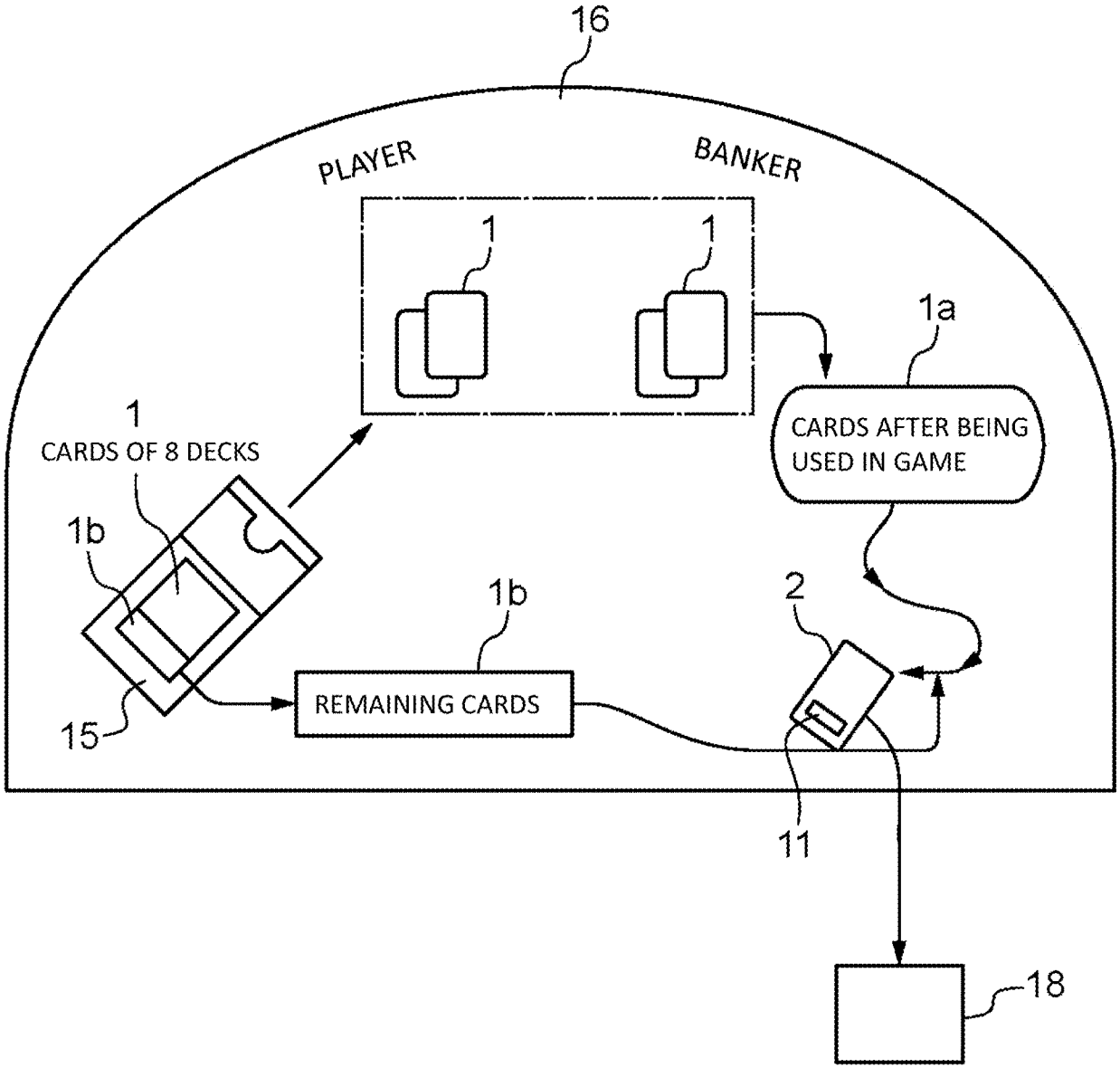
FIG. 10 is an explanatory view illustrating a state in which the used playing cards are discarded in the disposal box according to the first embodiment of the present invention.
Figure 11:
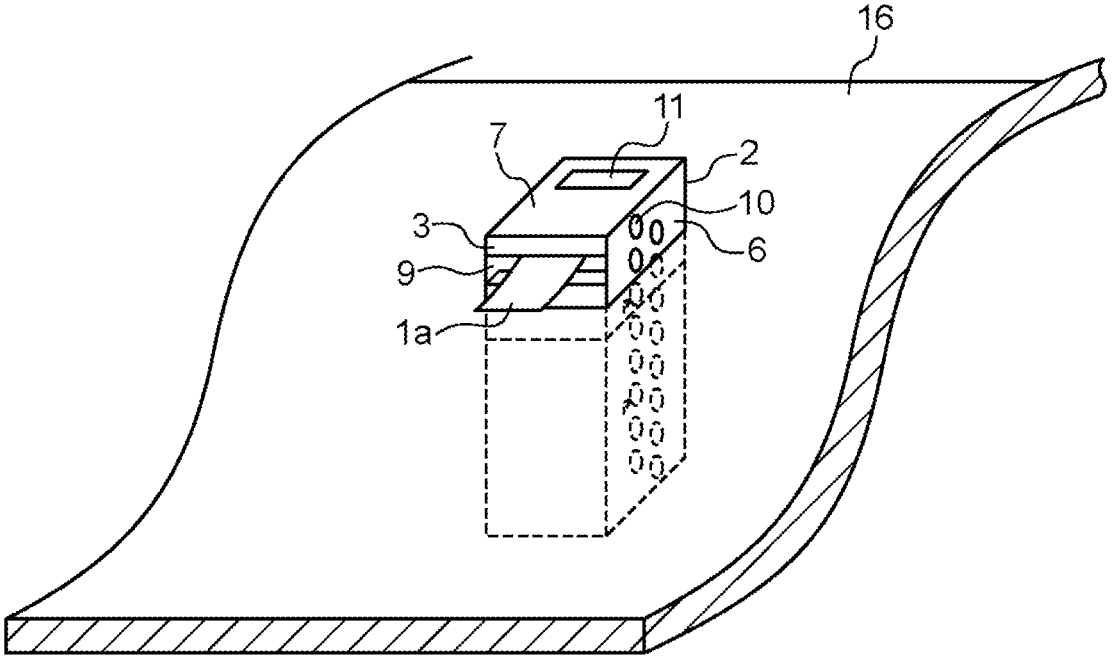
FIG. 11 is an explanatory view illustrating a state in which the disposal box according to the first embodiment of the present invention is provided in a game table.

Next, a method of inserting the used playing cards 1*a* into the disposal box 2 to discard the used playing cards 1*a* will be described with reference to FIGS. 10 and 11. FIG. 10 is an explanatory view illustrating a state in which the used playing cards are discarded in the disposal box according to the first embodiment of the present utility model, and FIG. 11 is an explanatory view illustrating a state in which the disposal box according to the first embodiment of the present invention is provided in a game table. As illustrated in FIG. 11, a disposal box accommodation hole for burying the disposal box 2 is formed in a table 16, and the disposal box 2 is fitted into and used in the disposal box accommodation hole in a state in which the slit cover 12 is opened. The disposal box accommodation hole has a depth at which the slit 9 formed in the upper part of the front surface 3 is positioned at the same height as that of an upper surface of the table 16 or is positioned at a position slightly higher than the upper surface of the table 16 as illustrated in FIG. 11 when the disposal box 2 is fitted into the disposal box accommodation hole. Therefore, when the disposal box 2 is fitted into the disposal box accommodation hole formed in the table 16, the slit 9 is positioned at the same height as that of the upper surface of the table surface 16 or is positioned at the position slightly higher than that of the upper surface of the table 16.

As illustrated in FIG. 10, after a predetermined number of playing cards 1 (for example, 52 cards×8 decks=416 cards when 8 decks are used) managed in a package unit are received in a shooter 15 used in a casino or the like, the predetermined number of playing cards 1 are distributed to a player (customer) on the game table 16 by a dealer and are used in a game.

The used playing cards 1*a* used in the game are brought to the disposal box 2 installed in the game table 16 by the dealer, and are inserted into the disposal box 2 through the slit 9. The dealer can visually recognize the stacked uppermost used playing card 1*a* by looking into the inside of the disposal box 2 from the viewing hole 11 in a state in which the disposal box 2 is fitted into the disposal box accommodation hole of the table 16, such that the dealer can confirm that the used playing cards 1*a* are accommodated in the disposal box 2 and an approximate amount of the used playing cards 1*a* accommodated in the disposal box 2.

When both of the used playing cards 1*a* and the remaining playing cards 1*b* that are not used in the game are thrown into the disposal box 2 through the slit 9, the dealer pulls up the disposal box 2 from the game table 16. Then, as shown in FIG. 3, the slit cover 12 is closed to cover the slit 9, thereby preventing the used playing cards 1*a* from coming out from the slit 9. The dealer further sticks a void seal or the like, for stopping the slit cover 12 using a seal sticking position guide 17. Then, the disposal box 2 accommodating the used playing cards 1*a* is taken into and discarded in a disposal facility 18 in the casino.

When the used playing cards 1*a* are discarded, the used playing cards 1*a* contained in each disposal box 2 are discarded. As described above, since the disposal box 2 is formed of the paper or plastic material, the disposal box 2 can be cut by a general cutting machine, and can be incinerated as it is as combustible waste. That is, the disposal box 2 according to the present embodiment is a disposable disposal box. In addition, at the time of discarding the disposal box, it is possible to read the ID code attached to the disposal box 2 and associate the read ID code with an ID of an associated package to leave a record indicating that the disposal box was discarded. In addition, since the disposal box is sealed in a package unit and is managed by the ID code, when there is a case that any disposal box 2 has been lost and not discarded, such a case can be found.

In addition, in the above embodiment, the slit 9 is provided in the front surface 3, but the slit 9 may be provided in the other surface. Further, in the above embodiment, the viewing holes 10 are provided in the right surface, but the viewing holes 10 may be provided in any one of the front surface 3, the back surface 4, and the left surface 5.

Figure 12:
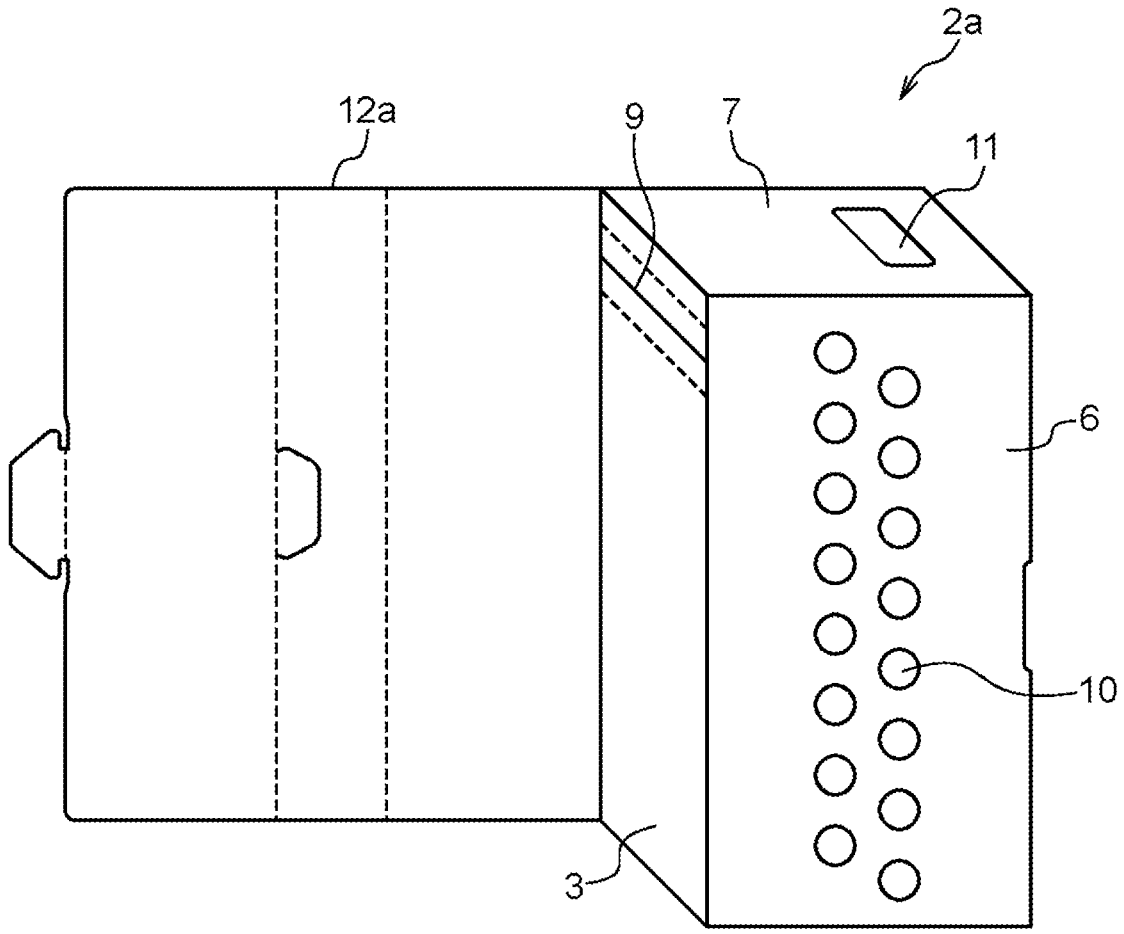
FIG. 12 is a perspective view of a disposal box according to a second embodiment of the present utility model.
Figure 13:
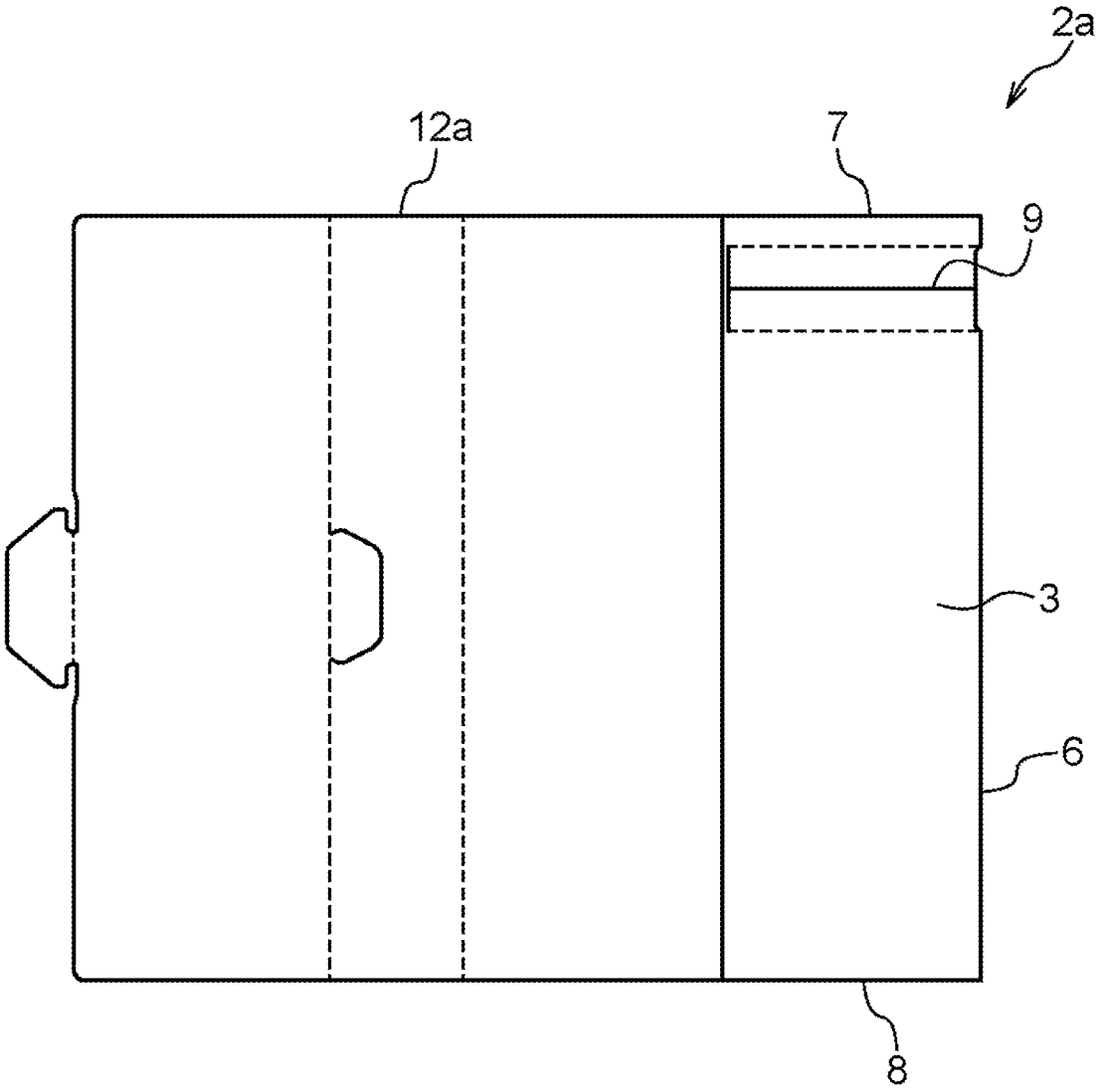
FIG. 13 is a front view of the disposal box according to the second embodiment of the present utility model in a state in which a slit cover of the disposal box is opened.
Figure 14:
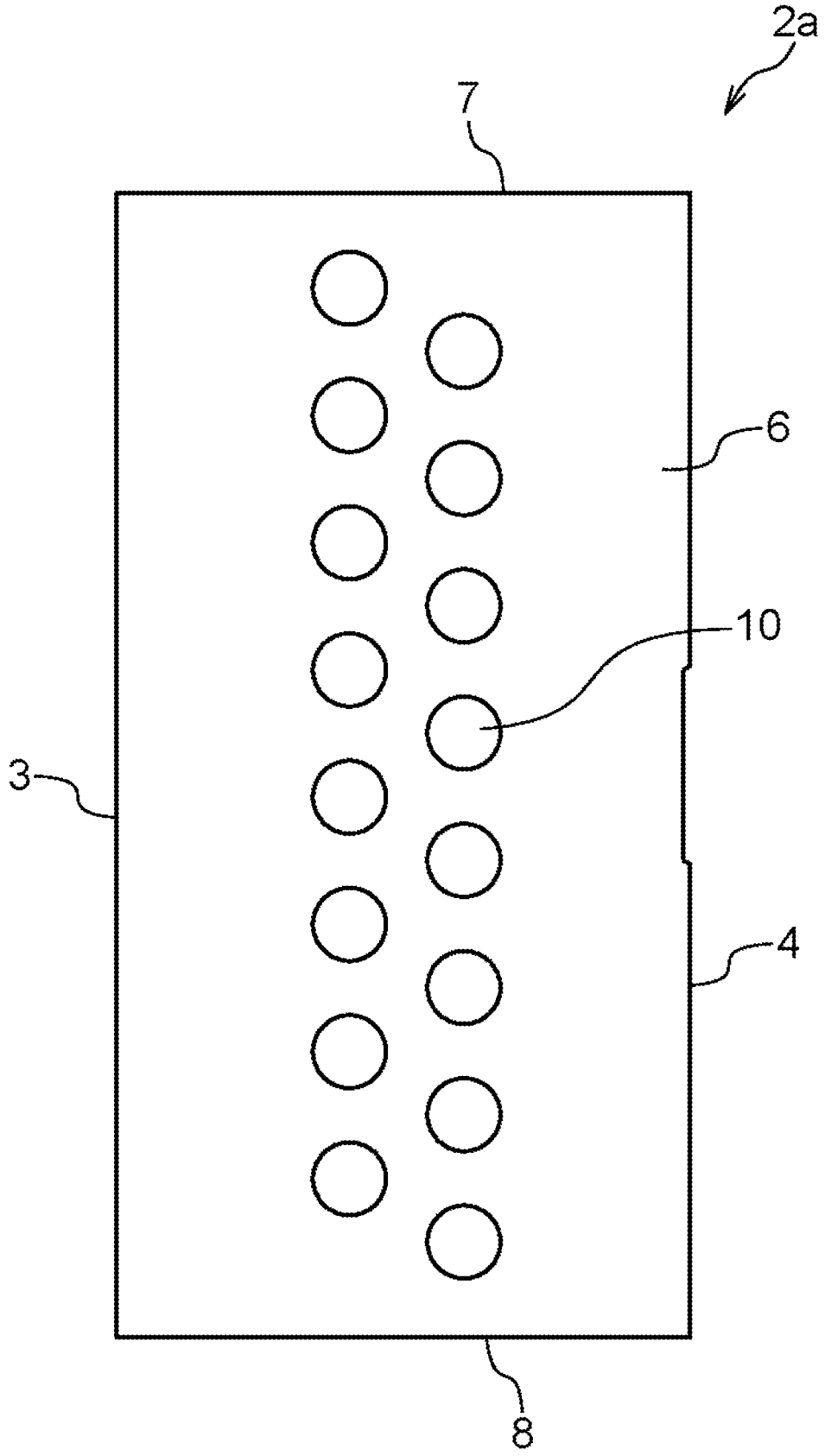
FIG. 14 is a right side view of the disposal box according to the second embodiment of the present invention.
Figure 15:
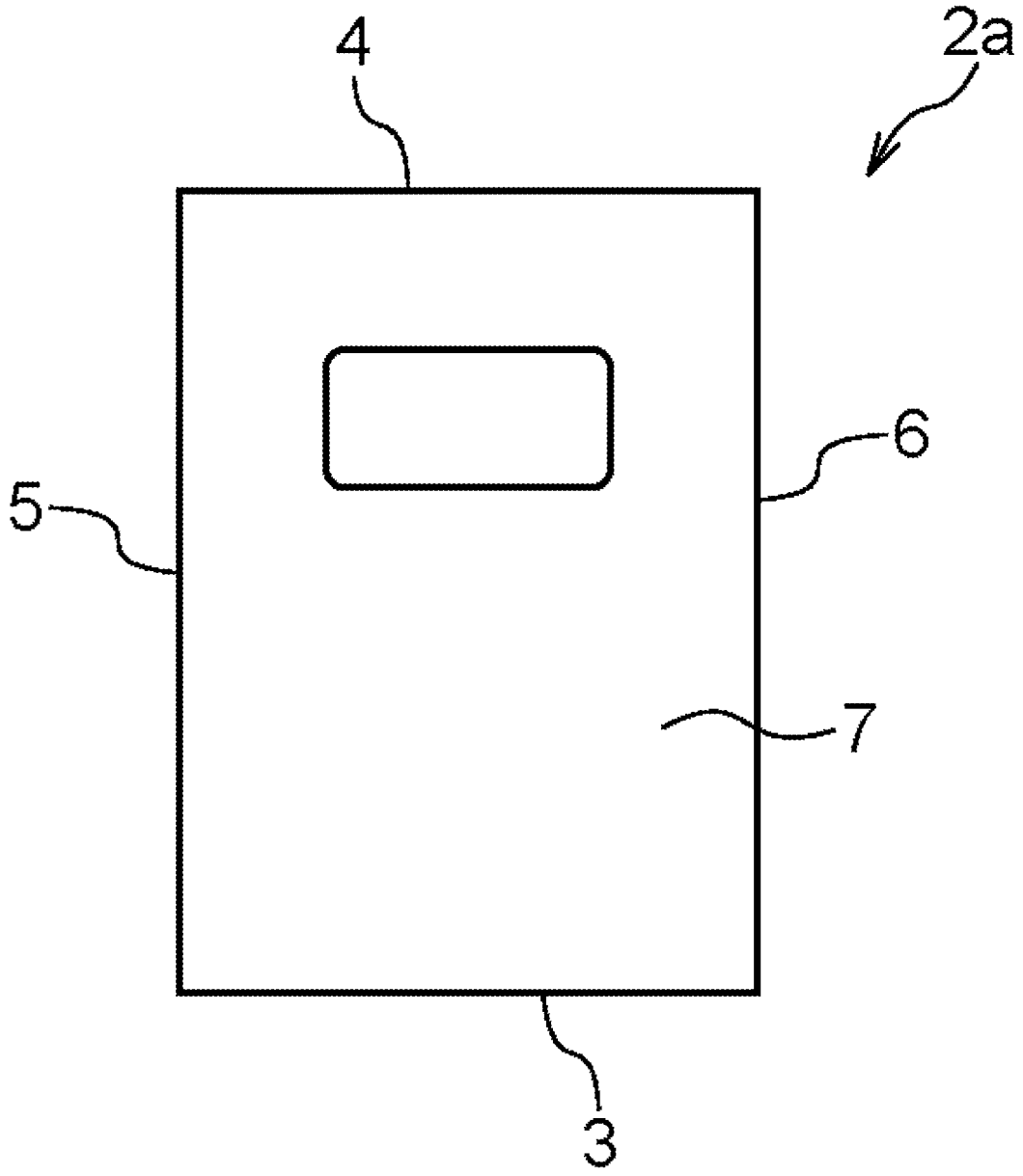
FIG. 15 is a plan view of the disposal box according to the second embodiment of the present invention.
Figure 16:
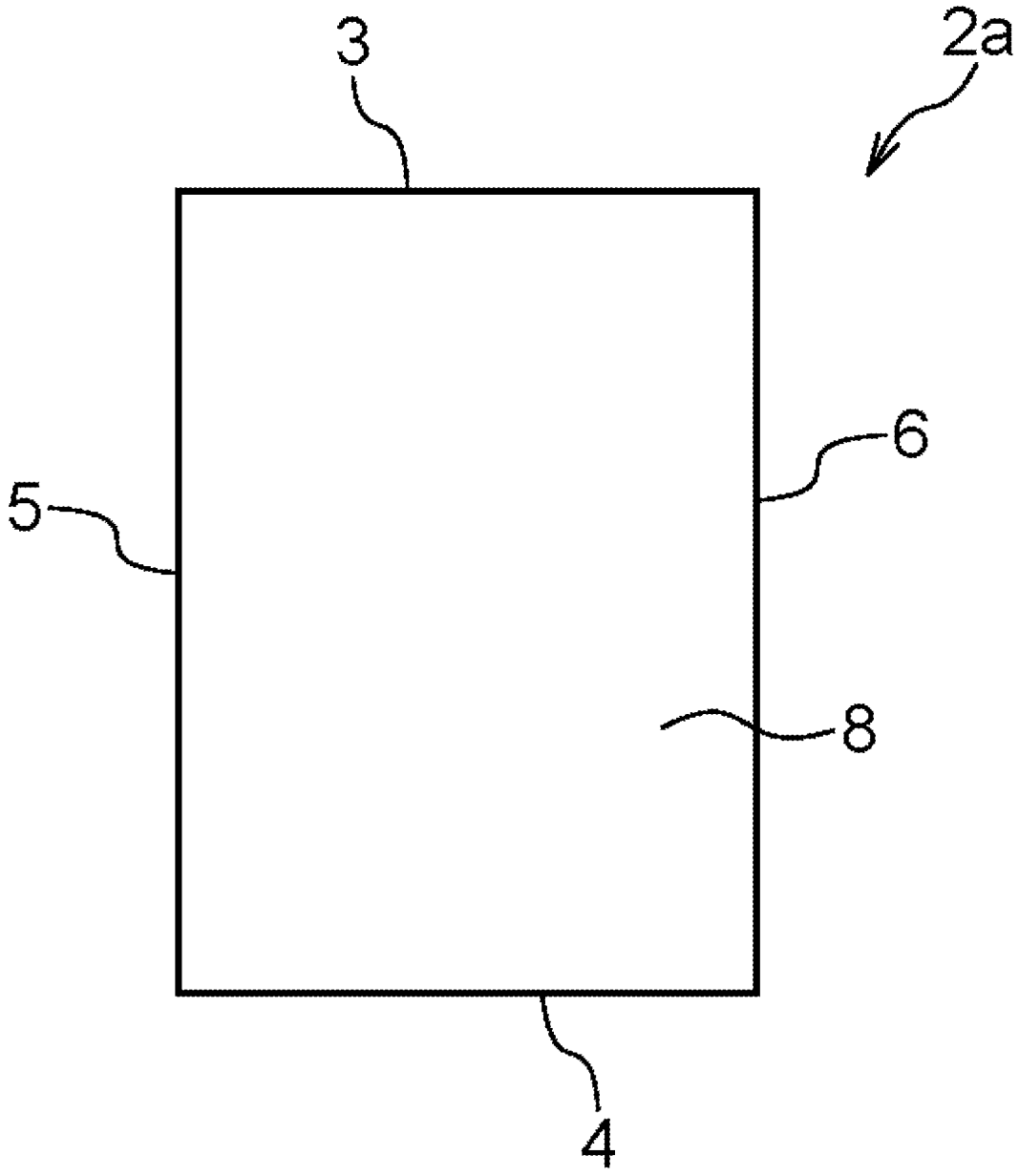
FIG. 16 is a bottom view of the disposal box according to the second embodiment of the present invention.
Figure 17:
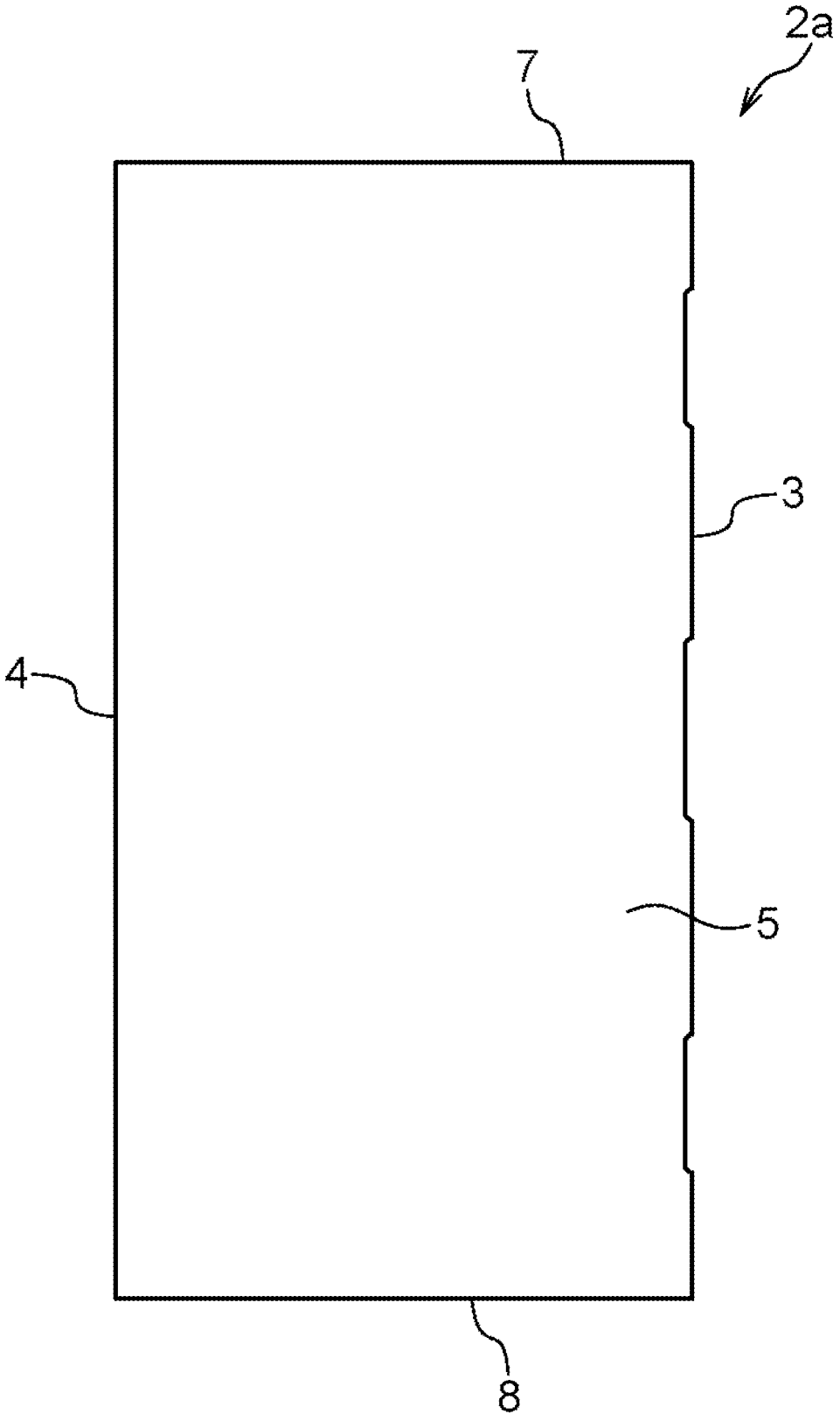
FIG. 17 is a left side view of the disposal box according to the second embodiment of the present invention.

FIG. 12 is a perspective view of a disposal box according to a second embodiment of the present invention. In addition, FIG. 13 is a front view of the disposal box according to the second embodiment of the present invention, and illustrates a state in which a slit cover 12*a* is opened. FIGS. 14 to 18 are, respectively, a right side view, a plan view, a bottom view, a left side view, and a development view of the disposal box according to the second embodiment of the present invention. In a disposal box 2*a* of FIGS. 12 to 18, the same components as those of the disposal box 2 according to the first embodiment are denoted by the same reference numerals, and a description thereof is omitted.

Figure 18:
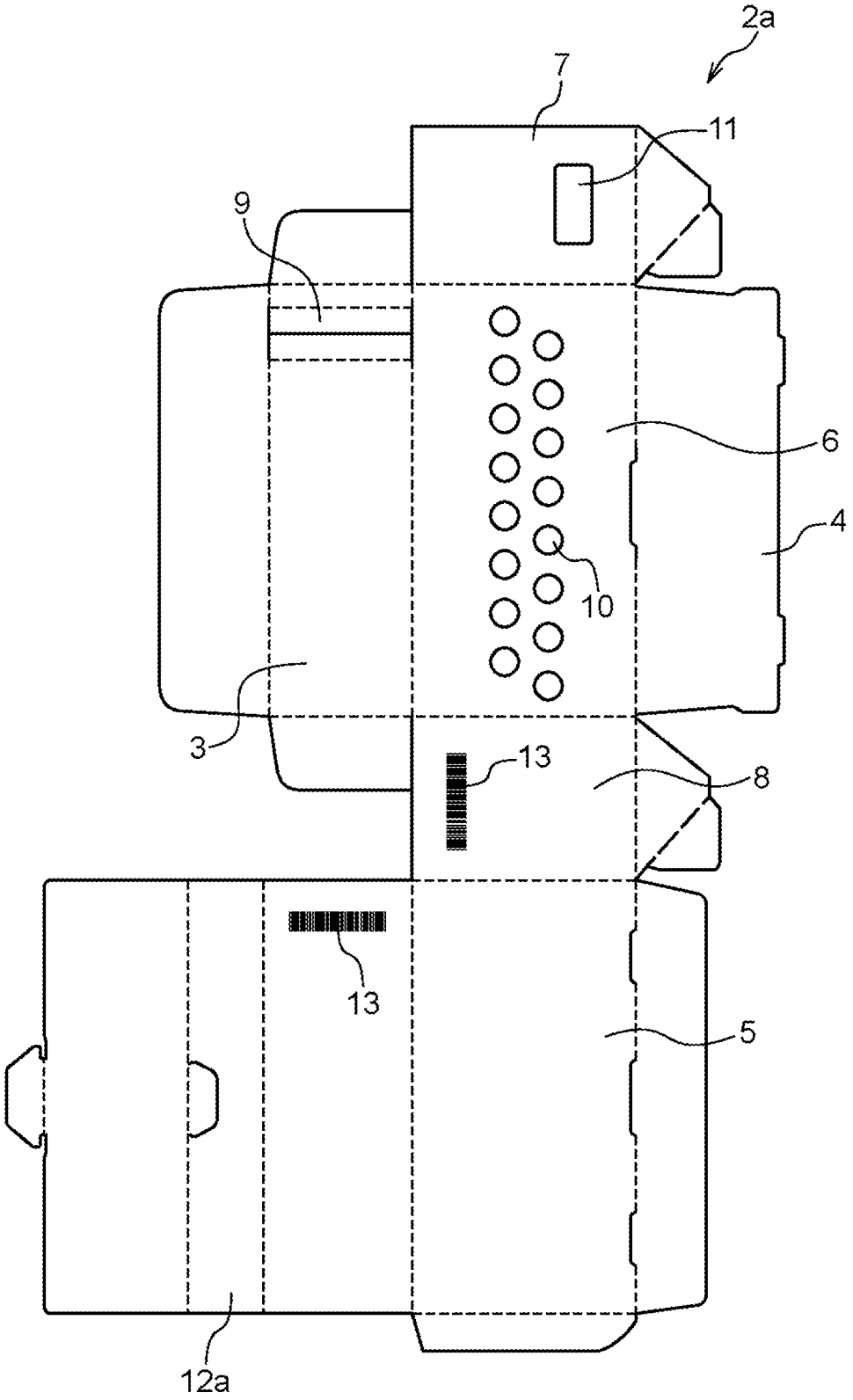
FIG. 18 is a development view of the disposal box according to the second embodiment of the present invention.

The disposal box 2*a* according to the second embodiment of the present invention is different from the disposal box 2 according to the first embodiment in that the slit cover 12*a* has a structure in which it covers both of a slit 9 and viewing windows 10. That is, as illustrated in FIGS. 12, 13, and 18, the slit cover 12 has a sufficient width, such that the slit cover 12 can cover a front surface 3 in which the slit 9 is provided and a right surface in which a plurality of viewing holes 10 are provided.

The disposal box 2*a* is fitted into a disposal box accommodation hole of a table 16 in a state in which the slit cover 12*a* is opened. When a predetermined number of used playing cards 1*a* are accommodated in the disposal box, a dealer takes the disposal box 2*a* out of the disposal box accommodation hole of the table 16, and covers the front surface 3 and the right surface 6 by the slit cover 12*a*. As in the first embodiment, after the slit cover 12*a* is closed in this way, a void seal or the like, for stopping the slit cover 12 may further be stuck.

Figure 19:
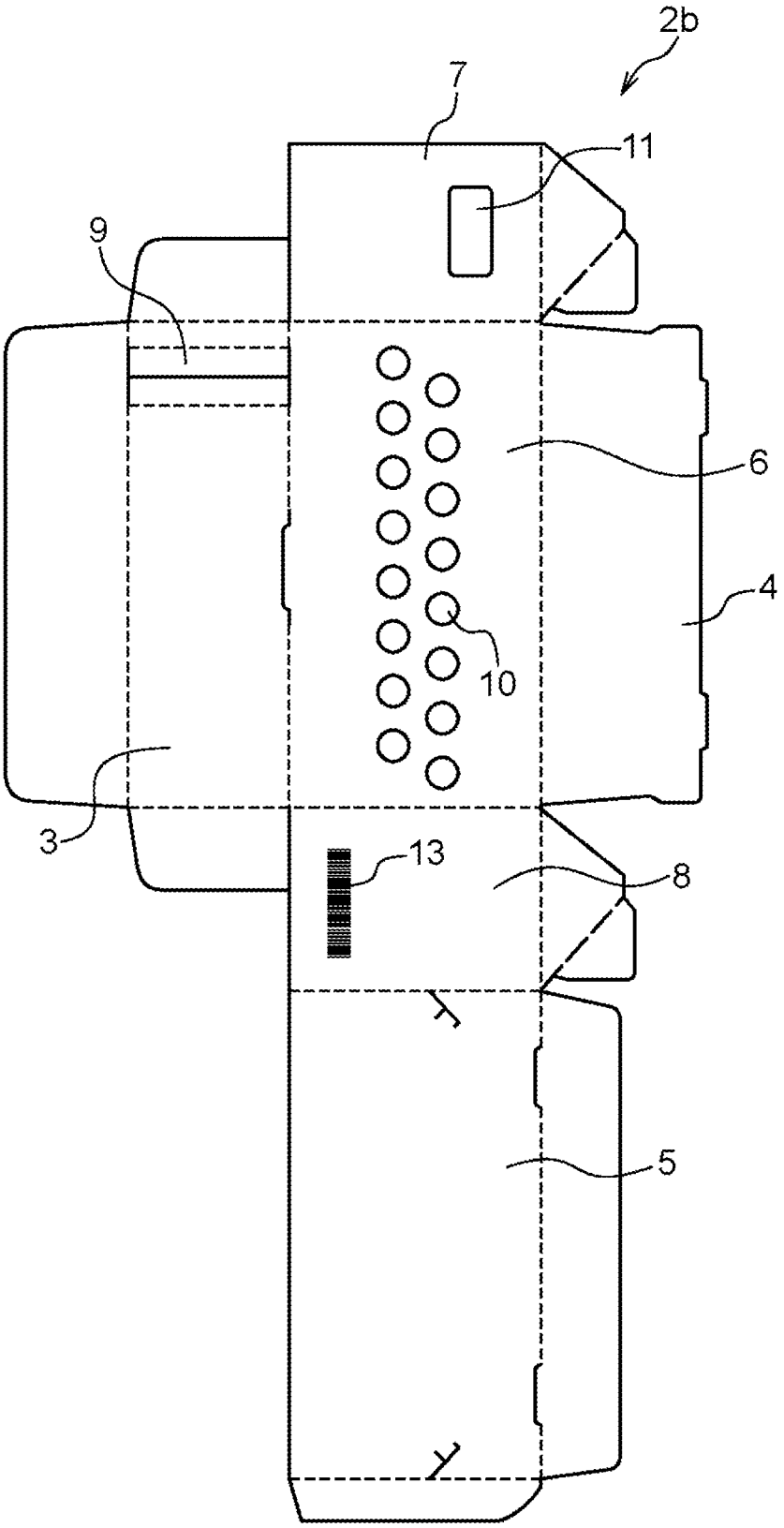
FIG. 19 is a development view of a disposal box according to a third embodiment of the present invention.

FIG. 19 is a development view of a disposal box according to a third embodiment of the present invention. In FIG. 19, the same components as those of the disposal box 2 according to the first embodiment are denoted by the same reference numerals, and a description thereof is omitted. The disposal box 2*b* according to the present embodiment has a structure in which a slit cover 12 does not exist. In the present embodiment, after a predetermined number of used playing cards 1*a* are accommodated in the disposal box 2, a seal for sealing the slit 9 is stuck so as to close the slit 9.

INDUSTRIAL APPLICABILITY

The disposal box for used playing cards used in the table game according to the present invention can easily and certainly discard the used playing cards in a package unit without the used playing cards being illegally taken out, which leads to reduction in operation cost, and improvement of safety as well as improvement of workability of the game. Therefore, the disposal box for used playing cards is useful for a table game in casino or the like.

REFERENCE SIGNS LIST

1 playing card
1*a* used playing card
1*b* remaining playing card
2, 2*a*, 2*b* disposal box
3 front surface
4 back surface
5 left surface
6 right surface
7 upper surface
8 lower surface
9 slit
10 viewing window
11 viewing hole
12 slit cover 12*a* slit cover according to second embodiment
13 barcode
14 guide indication
15 shooter
16 game table
17 seal sticking position guide
18 disposal facility

The invention claimed is:

1. A disposal box comprising:

a slit formed on a part of the disposal box through which a plurality of used playing cards are insertable into the disposal box, wherein the disposal box positioned on a game table and is removable from the game table together with the inserted used playing cards in a state in which the inserted used playing cards are contained in the disposal box.

2. The disposal box according to claim 1, wherein, when the disposal box is positioned on the game table, the slit is positioned at a same height as or higher than that of an upper surface of the game table.

3. The disposal box according to claim 1, wherein a viewing window for confirming an amount of used playing cards contained in the disposal box is provided in at least one of a front surface, a back surface, a left surface, and a right surface of the disposal box.

4. The disposal box according to claim 3, wherein a guide indication indicating the number of used playing cards contained in the disposal box is further attached to the surface in which the viewing window is provided.

5. The disposal box according to claim 1, wherein a plurality of viewing windows for confirming an amount of used playing cards contained in the disposal box are provided in at least one of a front surface, a back surface, a left surface, and a right surface of the disposal box, and each of the plurality of viewing windows has a size at which the used playing cards contained in the disposal box cannot be taken out of the disposal box.

6. The disposal box according to claim 5, wherein the plurality of viewing windows form lines side by side in a direction in which the used playing cards are stacked in the disposal box, a plurality of lines are arranged in a plane direction of each used playing card accommodated in the disposal box, and the viewing windows of adjacent ones of the side by side lines are alternately provided, such that each used playing card contained in the disposal box can always be visually recognized from any one of the viewing windows.

7. The disposal box according to claim 1, wherein a viewing hole for viewing at least one used playing card accommodated in the disposal box is formed on an upper surface of the disposal box.

8. The disposal box according to claim 1, further comprising a slit cover or a seal for sealing the slit after a predetermined number of used playing cards are inserted into the disposal box.

9. The disposal box according to claim 8, wherein a sticking position of the seal that limits opening and closing of the slit cover after the slit is sealed is further clearly marked on the slit cover.

10. The disposal box according to claim 1, wherein a printing or a barcode indicating a different ID is given to each set of used playing cards.

11. The disposal box according to claim 1, further comprising:

a first panel in which the slit is formed; and a second panel that is foldable onto the first panel, thereby covering, and blocking card entry into and card removal from, the slit.

12. The disposal box according to claim 11, further comprising:

a third panel; and a seal sealing the second panel, in a state in which the second panel is folded onto the first panel, to a third panel that is immediately adjacent the first panel.

13. The disposal box according to claim 11, further comprising:

a third panel, wherein the second panel is attached to a first edge at which the third panel meets the first panel.

14. The disposal box according to claim 13, further comprising:

a fourth panel, wherein the disposal box is structured so that, when the second panel is folded onto the first panel, the second panel extends from the first edge to a second edge at which the first panel meets the fourth panel, a first end of the first panel being immediately adjacent to the third panel and a second end of the first panel that is opposite the first end of the first panel being immediately adjacent to the fourth panel.

15. The disposal box according to claim 14, further comprising:

a fifth panel to which the second panel is connected, wherein, when the second panel is folded over the first panel, the fifth panel is foldable over the fourth panel.

16. The disposal box according to claim 14, wherein the fourth panel includes one or more viewing windows that are coverable by the fifth panel when the fifth panel is folded over the fourth panel.

17. The disposal box according to claim 11, wherein the second panel includes a tab that is insertable into a tab receptacle formed in the first panel or formed at an edge at which the first panel meets a third panel.

18. The disposal box according to claim 1, further comprising:

a first panel in which the slit is formed; and a seal covering the slit.

19. The disposal box according to claim 1, wherein the disposal box is structured so that, while the used playing cards are accommodated within the disposal box, the disposal box and the accommodated used playing cards are cuttable together.

20. A system comprising:

a disposal box comprising a box shaped housing, wherein a slit is formed on a part of the housing, wherein a plurality of used playing cards are insertable into the housing of the disposal box, through the slit, and wherein the disposal box is configured to be positioned on a game table and is removable from the game table together with the inserted used playing cards in a state in which the inserted used playing cards are stored within the disposal box.

21. The system according to claim 20, wherein a plurality of viewing windows are formed in at least one surface of the housing of the disposal box.

22. The system according to claim 20, wherein a viewing hole is formed in an upper surface of the housing of the disposal box.

23. The system according to claim 20, wherein the disposal box further comprises:

a seal for sealing the slit after a predetermined number of used playing cards are inserted into the disposal box; and an indication on the housing, the indication configured to indicate an ID corresponding to the playing cards stored in the disposal box.

24. The system according to claim 23, further comprising on the housing a marking of a sticking position at which the seal is positioned onto the housing.

25. The system according to claim 20, further comprising: the game table, the game table comprising a surface for use with a plurality of playing cards and being configured to receive the disposal box such that the slit is positioned at the same height as that of the surface.

26. The system according to claim 20, further comprising: the game table, the game table comprising a surface for use with a plurality of playing cards and being configured to receive the disposal box such that the slit is positioned at a position higher than the surface of the game table.

* * * * *